United States Patent [19]

Fujiwara et al.

[11] Patent Number: 4,777,875

[45] Date of Patent: Oct. 18, 1988

[54] PRINTER HEAD BANK AND METHOD OF MANUFACTURING THE SAME

[75] Inventors: Shinsuke Fujiwara; Kunio Endo, both of Osaka, Japan

[73] Assignee: NEC Home Electronics Ltd., Osaka, Japan

[21] Appl. No.: 6,311

[22] Filed: Jan. 15, 1987

Related U.S. Application Data

[63] Continuation of Ser. No. 718,381, Apr. 1, 1985, abandoned.

[30] Foreign Application Priority Data

Mar. 30, 1984 [JP] Japan ..... 59-62841
Jun. 29, 1984 [JP] Japan ..... 59-134408

[51] Int. Cl.[4] ..... B41J 3/10

[52] U.S. Cl. ..... 101/93.04; 400/694; 400/352

[58] Field of Search ..... 400/124, 719, 121, 320, 400/352, 694; 101/93.04, 93.05

[56] References Cited

U.S. PATENT DOCUMENTS

| | | | |
|---|---|---|---|
| 4,258,623 | 3/1981 | Barrus et al. | 101/93.04 |
| 4,300,845 | 11/1981 | Martin et al. | 101/93.05 |
| 4,350,450 | 9/1982 | Durr et al. | 101/93.05 |

FOREIGN PATENT DOCUMENTS

| | | | |
|---|---|---|---|
| 39651 | 11/1981 | European Pat. Off. | 400/124 |
| 2807337 | 8/1978 | Fed. Rep. of Germany | 400/124 |
| 148177 | 11/1980 | Japan | 400/124 |
| 56-146789 | 11/1981 | Japan | 400/694 |
| 58-65672 | 4/1983 | Japan | 101/93.05 |
| 2082508 | 3/1982 | United Kingdom | 400/124 |

*Primary Examiner*—David A. Wiecking
*Attorney, Agent, or Firm*—Cushman, Darby & Cushman

[57] ABSTRACT

A printer head bank in which an assembly of yoke, magnet, coils and printing board are encapsulated in a resin forming the head carriage to which the typing hammers are attached.

7 Claims, 2 Drawing Sheets

PRINTER HEAD BANK AND METHOD OF MANUFACTURING THE SAME

This is a continuation of application Ser. No. 718,381, filed 4/1/85, now abandoned.

BACKGROUND AND SUMMARY OF THE INVENTION

The invention relates to a printer head bank for a printer used as an output unit, as for example, for a personal computer and the like.

Printer head banks used as output units for personal computers and the like have been heretofore fabricated in the manner shown in FIGS. 1-3. In FIGS. 1, 2 and 3 numerals 10, 11 and 12 designate a head carriage, permanent magnet, and a yoke, respectively. Numerals 13, 14, 15 and 16 denote coils, typing hammers, circuit boards, and connectors for coupling coils 13 and boards 15 to other devices. Numeral 17 are screws for fixing the yoke to carriage 10. These elements form what could be termed a head assembly.

Carriage 10 is machined and the assembly fixed onto its top including yoke 12 to which the permanent magnet 11, coils 13, circuit boards 15, and connectors 16 are attached. Head carriage 10 is held fast by screws 17. The typing hammers 14 include a comblike leaf spring 20 and a hammer pins 21 and are each actuated by and associated with a coil 13. Base 22 of leaf spring 20 is fixed to a mounting surface 23 at the front of carriage 10 by screws 24. Movements of yoke 12 in vertical and longitudinal directions are limited by surfaces 25 and 26, respectively. The surface 26 is defined by projections 27 extending in front of carriage 10 on the top thereof.

One disadvantage of this conventional arrangement is that machining head carriage 10 requires considerable time, making it expensive. Further, positioning yoke 12 when the printer is assembled is difficult, also requiring much time. In particular, the relative position between the typing hammers 14 and yoke 12 has a delicate effect on the punching or gapping force and the attractive force and the like and must be carefully adjusted to ensure accuracy of the printer. However, a tolerance is normally provided between the screw holes formed in yoke 12 of the head carriage 10 when yoke 12 is fixed to head carriage 10 by screws 17. This can result in misalignment in the relative position between typing hammers 14 and yoke 12, exerting a bad influence on accuracy of the printer. In order to counteract such effect, a thin metal foil which is capable of rectifying gap tolerance is normally interposed between yoke 12 and surface 26 for gap adjustment.

The present invention aims for its object at requiring no yoke positioning when the head carriage is machined and assembled and at making the head bank lightweight.

For achievement of such object, the head carriage 10 is molded of a resin and simultaneously, the head assembly including permanent magnet 11, yoke 12, coils 13, circuit boards 15, and connectors 16 integrally encapsulated therein. Thus, the necessity of screws 17 for securing and locating the yoke is avoided, and machining of the head carriage 10 is not required so that a highly dependable head bank may be made inexpensively.

Conventionally the circuit board 15 extends adjacent magnet 11 and weakens the magnetic force. According to a second embodiment cables are encapsulated in the carriage to directly connect the coils to an external control circuit, also simplifying assembly.

DETAILED DESCRIPTION OF THE DRAWINGS

Figure 1:
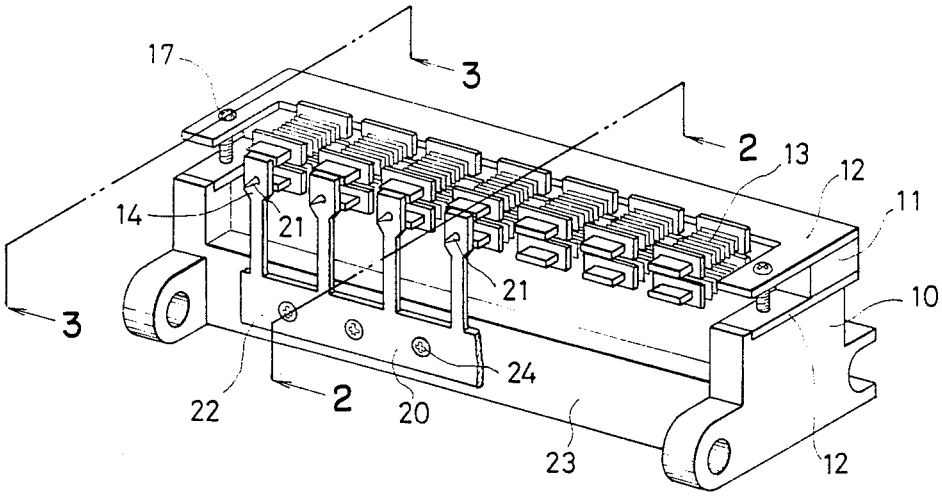
FIG. 1 PRIOR ART
FIG. 1 is a perspective view of a conventional prior art printer head.
Figure 2:
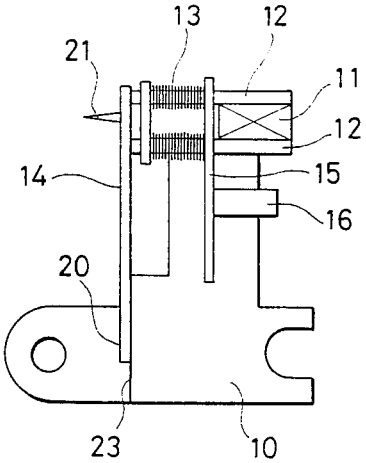
FIG. 2 PRIOR ART
FIGS. 2 and 3 are sections taken along the lines 2—2 and 3—3 of FIG. 1. showing the printer head according to the prior art
Figure 3:
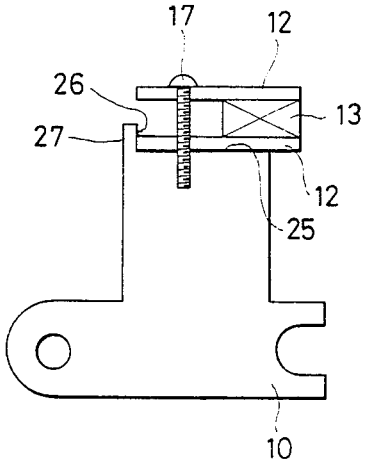
FIG. 3 PRIOR ART
Figure 4:
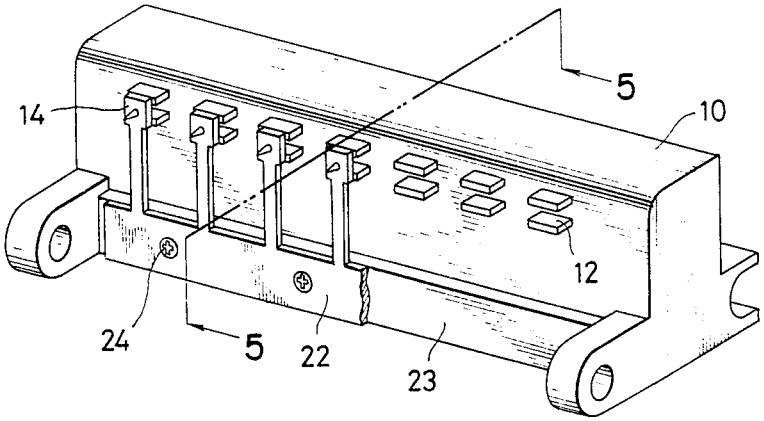
FIG. 4 is a perspective view of a head bank embodying the present invention.
Figure 5:
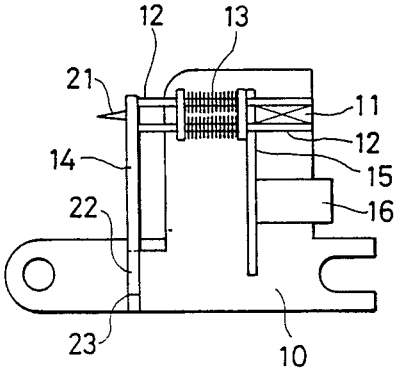
FIG. 5 is a sectional view taken along with the line 5—5 of FIG. 5.

FIGS. 4 and 5 are views similar to FIGS. 1 and 2 but show a first embodiment of the present invention. Like numerals are used to designate like or similar parts as in FIGS. 1-3, thus needing no explanation hereof, except that the head carriage 10 has been molded of a suitable resin and a head assembly with permanent magnet 11, yoke 12, coils 13, circuit boards 15, and connectors 16 has been integrally encapsulated when the head carriage 10 is molded.

Permanent magnet 11, yoke 12, coils 13, circuit boards 15, and connectors 16 and the like are first assembled. This assembly is then placed in a predetermined position within a mold for molding the head carriage 10. Resin is then conventionally poured or forced into the mold. The base of the typing hammers 14 is held fast by the screws 24 to the mounting surface 23 in front of the molded head carriage 10.

Advantages derived from the present invention are that no location of the yoke 12 is required to facilitate assembling, and that the necessity of machining the head carriage is avoided, thereby making the head bank inexpensive. Particularly, not only the position of the yoke 12 and typing hammers 14 are determined by positioning the yoke 12 by means of mold formation of the head carriage 10 but also the position of the mounting surface 23 on which the typing hammers 14 are rigidly mounted is determined by mold formation. This minimizes errors or tolerances which may otherwise result from mounting parts such as screws and the like.

Figure 6:
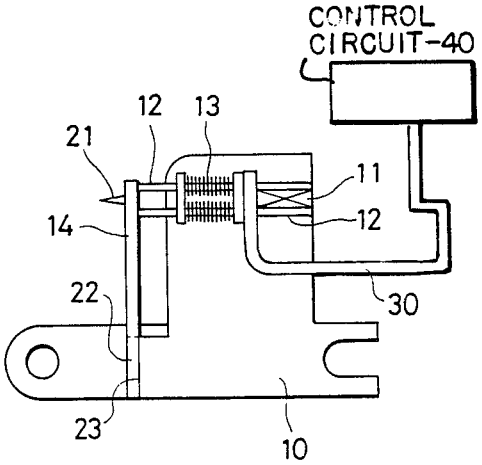
FIG. 6 shows a sectional view of a second embodiment of the invention.

FIG. 6 shows a second embodiment of the invention. Like elements have the same numerals as in FIGS. 4 and 5. As indicated above, the circuit board extends adjacent the magnet and weakens the magnetic force. Further, mounting the board and its connectors requires additional assembly. In FIG. 6 the functions of the circuit board are carried out by an external control circuit (40) and cable 30 encapsulated in head carriage 10 to connect coils 13 directly to that external circuit. Thus, assembly is simplified.

While the embodiment of the present invention as herein disclosed constitutes a line dot printer it is not limited thereto. For instance, the invention may be, of course, embodied in the head carriage of a serial type printer. Many changes and modifications in the above described emodiments of the invention may be carried out without departilng form the scope of the invention. That scope is limited only the scope of the appended claims.

We claim:

1. A printer head bank comprising:

a head assembly including a yoke, a magnet attached to said yoke, and a plurality of coils attached to said yoke; and means for accurately positioning said yoke, magnet and coils relative to each other comprising a head carriage being molded of resin and encapsulating said head assembly within said molded head carriage, said carriage having a plurality of typing hammers mounted directly thereto, each of said hammers being a leaf spring and being actuated by a corresponding one of said coils, the relative position of said yoke and said hammers being accurately determined by the formation of said molded head carriage.

2. A bank as in claim 1 further including screws for fixing said hammers to said head carriage, said hammers being positioned by said molded head carriage.

3. A bank as in claim 1 wherein said head assembly includes at least one circuit board.

4. A bank as in claim 1 wherein said head assembly includes a plurality of cables for connecting said coils directly to an external control circuit.

5. A method of manufacturing a printer head bank comprising:

assembling by accurately positioning a head assembly including a yoke, a magnet attached to said yoke, and a plurality of coils attached to said yoke;

molding a head carriage made of resin with said head assembly encapsulated therein;

attaching a plurality of typing hammers directly to said carriage, each of said hammers being a leaf spring and being actuated by a corresponding one of said coils, the relative position of said yoke and said hammers being accurately determined by the formation of said molded head carriage.

6. A method as in claim 5 wherein said typing hammers are attached to the molded head carriage using screws.

7. A method as in claim 5 including the further step of connecting cables directly to said coils to couple said coils to an external control circuit.

* * * * *